US005848716A

United States Patent [19]

Waranius

[11] Patent Number: 5,848,716

[45] Date of Patent: Dec. 15, 1998

[54] PORTABLE STICK LOCKER WITH REMOVABLE HANGERS

[76] Inventor: Kenneth E. Waranius, P.O. Box 593, Shasta, Calif. 96087

[21] Appl. No.: 980,981

[22] Filed: Oct. 2, 1997

[51] Int. Cl.[6] ..... A47B 47/00

[52] U.S. Cl. ..... 211/189; 211/205; 211/85.7

[58] Field of Search ..... 211/189, 205, 211/85.7

[56] References Cited

U.S. PATENT DOCUMENTS

| | | | |
|---|---|---|---|
| 723,114 | 3/1903 | Witt | 211/205 |
| 1,437,256 | 11/1922 | Martin | 211/189 |
| 4,164,968 | 8/1979 | Esposito, Jr. et al. | 150/1 |
| 4,502,576 | 3/1985 | Reardon | 206/287 X |
| 5,377,849 | 1/1995 | Martin | 211/85.7 |

*Primary Examiner*—Daniel P. Stodola
*Assistant Examiner*—Erica B. Harris

[57] ABSTRACT

A stand and attachable hooks for hockey sticks is a portable locker. The stand is tubular. Legs on the stand can be folded up. Hooks on a strap or string are in a carrier bag. In use, the legs of the stand are folded down, the hockey stick, is placed in the stand tube, and an alignment of hooks are attached to the stick handle by clips with the carrier over the hockey stick blade holding the upper end of the hook strap.

3 Claims, 4 Drawing Sheets

PORTABLE STICK LOCKER WITH REMOVABLE HANGERS

BACKGROUND OF THE INVENTION

1. Field of the Invention

This invention relates to portable devices using available equipment as hangers for clothing. The device of the present invention is particularly directed towards using a hockey stick in a stand with attachable hooks. The device is portable, can be folded up, and is useful in a boy's or girl's room as a stand to hang athletic or other clothing on. The device of this invention is also useful for traveling athletic teams where no locker space is available.

2. Description of the Prior Art

Although several types of portable clothes hanger devices are seen in past art patents and are available in the market place no devices seen are of an assemblage similar to the present invention.

SUMMARY OF THE INVENTION

Therefore, in practicing my invention, I provide a stand and attachable hooks for hockey sticks. The stand is tubular. Legs on the stand can be folded up. Hooks on a strap or string are in a carrier bag. In use, the legs of the stand are folded down, the hockey stick, is placed in the stand tube, and an alignment of hooks are attached to the stick handle by clips. The carrier bag is placed on the end of the hockey stick blade and is the upper holder for the hook strap. A wire clip in the stand tube holds the hockey stick handle in place.

As a principal object, the present invention provides portable locker hangers so a hockey stick can be used as a temporary clothing stand.

Another object of the invention is to provide hooks that can be temporarily attached to the handle of a hockey stick.

A further object of my invention is to provide a fold up tubular stand that can be used to support a hockey stick so the hockey stick can be used as a temporary clothing locker.

A still further object of the invention is to provide a portable locker that can be assembled and use for hanging clothing on when no lockers are available for a visiting team or in a boy's or girl's room.

Other objects and the many advantages of the present invention will become apparent from reading descriptions of numbered parts in the specification and comparing them with like numbered parts shown in the included drawings.

DESCRIPTION OF THE PREFERRED EMBODIMENT

Figure 1:
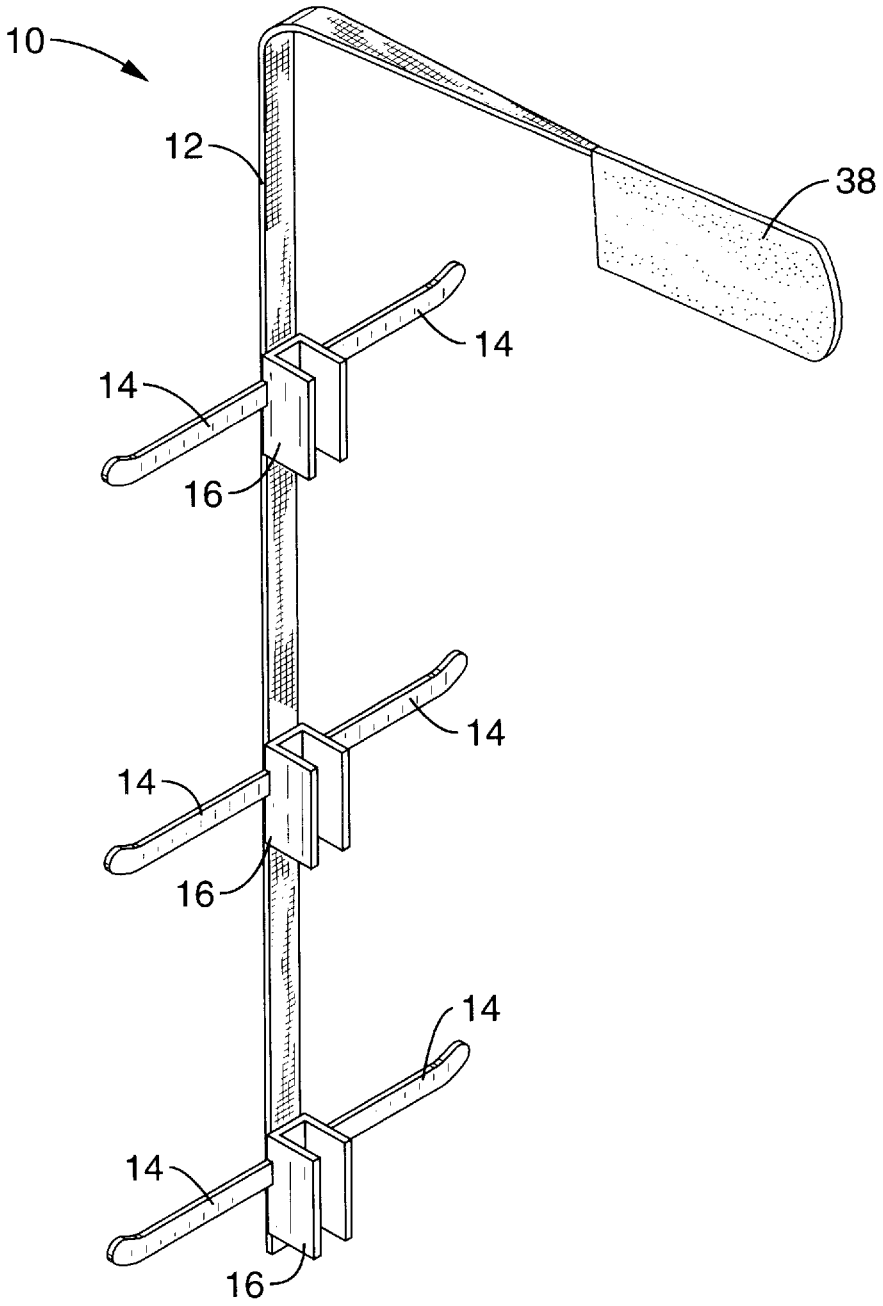
FIG. 1 shows a strap and hanger device with clip-on hooks in accordance with the invention.
Figure 2:
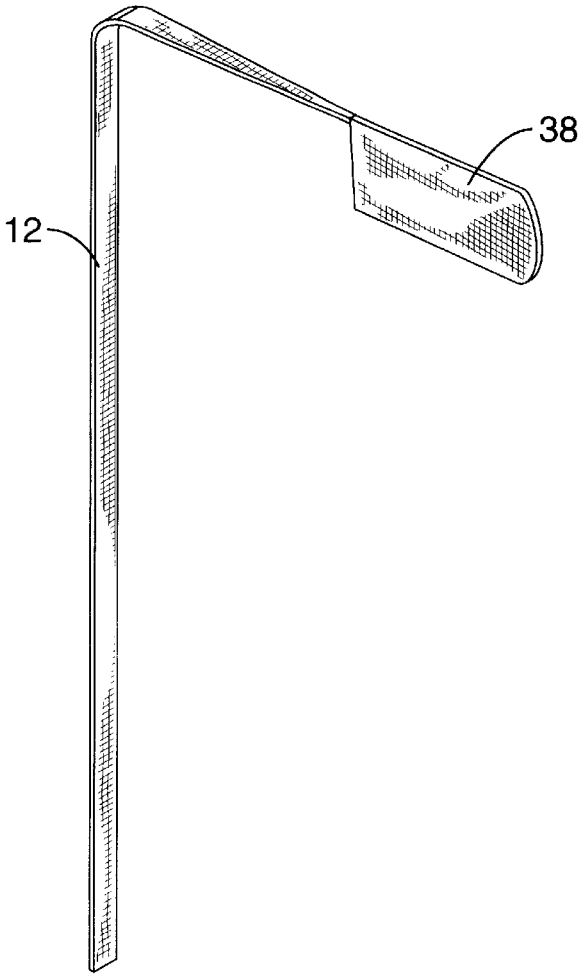
FIG. 2 shows the hook strap and carrier of this invention.
Figure 3:
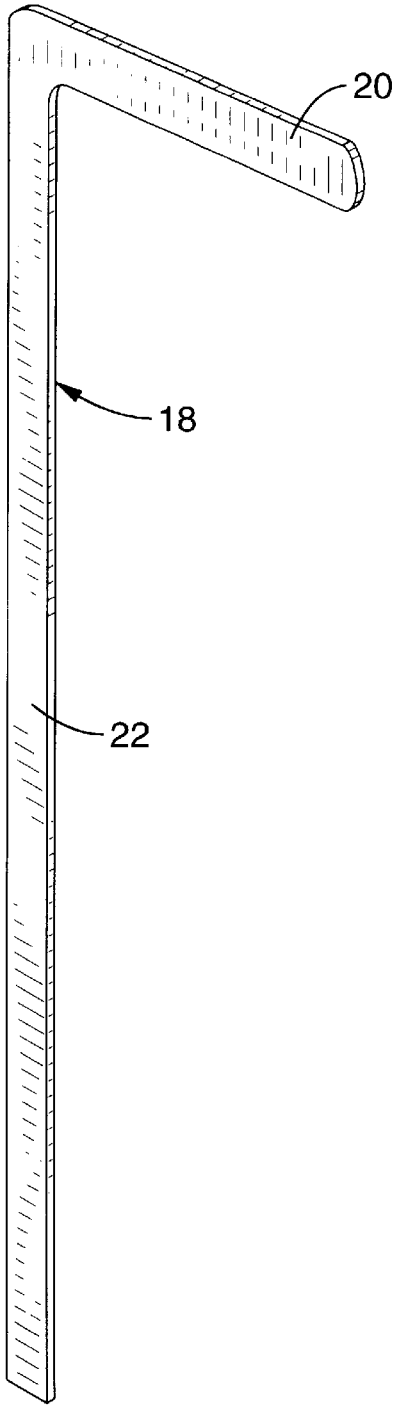
FIG. 3 shows a hockey stick useful as the hook support of the invention.
Figure 4:
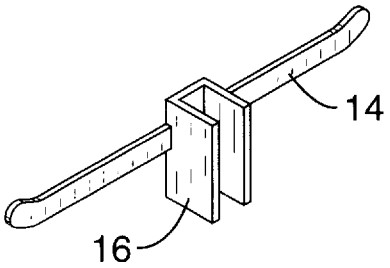
FIG. 4 shows one of the clip-on hooks used in the assemblage.
Figure 5:
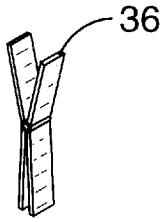
FIG. 5 shows a spring clamp that can be used on the hooks.
Figure 6:
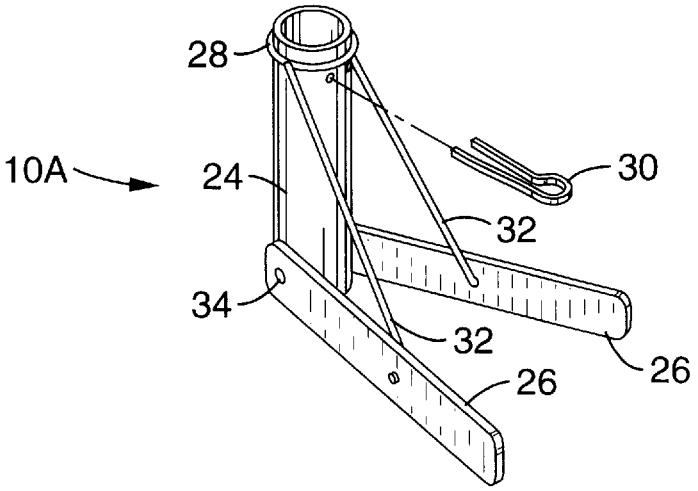
FIG. 6 shows the tubular stand with fold up legs and hockey handle clip.
Figure 7:
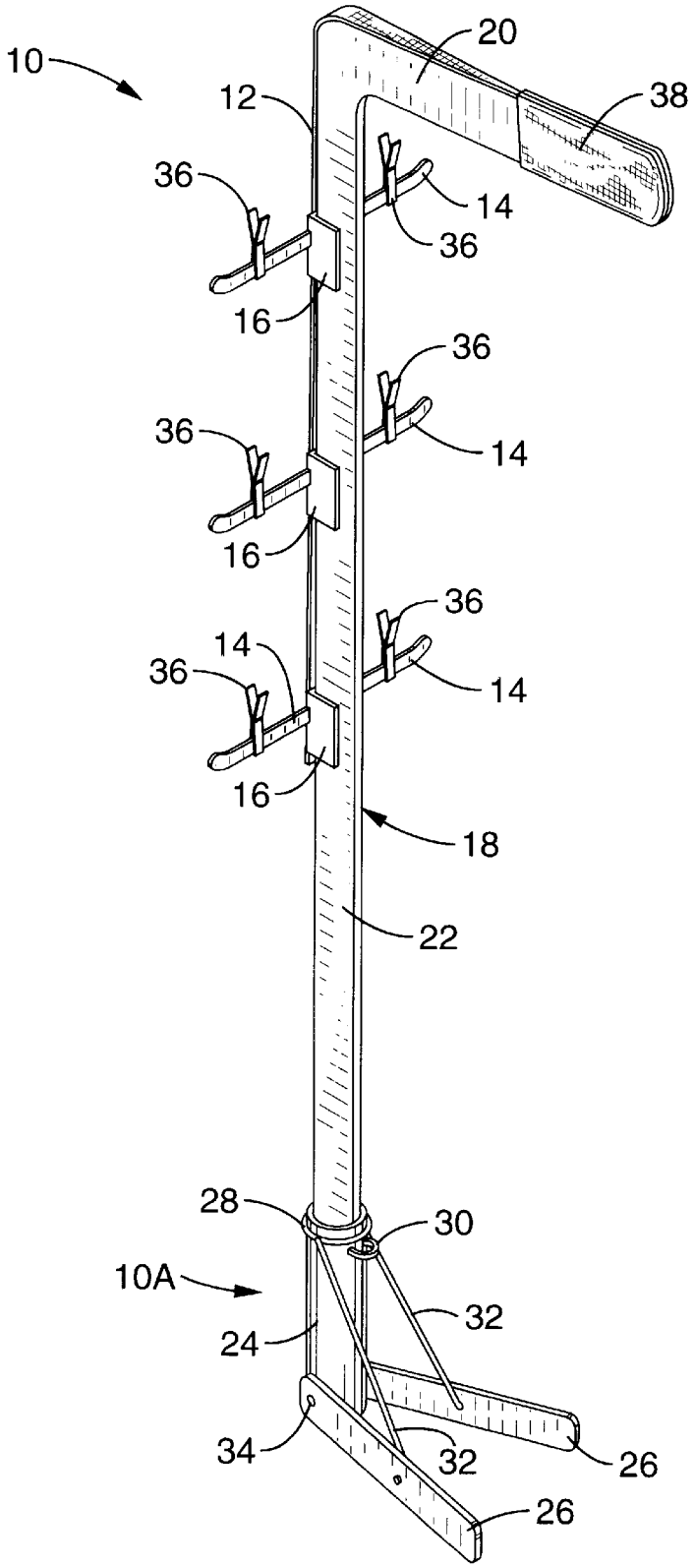
FIG. 7 shows the assembled device of this invention affixed to a hockey stick.

Referring now to the drawing Figures where the invention generally is referenced as invention 10 and 10A. The numbered parts include: hook line 12, hooks 14, channels 16, hockey stick 18, blade 20, shaft 22, stand tube 24, stand legs 26, wire support collar 28, hockey stick holder clip 30, tube braces 32, pin hinge 34, spring clips 36, and hook bag 38. Before attachment to hockey stick 18, the hook and line assemblage on 12 is packaged in carrier hook bag 38. Tube braces 32 are detached and legs 26 can be folded up. This makes a small package that can be held compact by a hook and loop strap around the outside.

Although I have described an embodiment of my invention with considerable details in the foregoing specification and illustrated it extensively in the drawings, it is to be understood that I may make changes in the structure of the device so long as any changes made remain within the scope of the appended claims and any changed devices similar to mine made by others that fall within my claim scope, I shall consider such devices to be my invention.

What is claimed is:

1. A portable stick locker with removable hangers, comprising:

a. a stick that has a first end, a second end, and a central body;

b. an alignment of hooks affixed on a flexible holder;

c. clips sized to snap onto the central body of said stick affixed centrally on said hooks;

d. a carrier bag sized to receive and hold said hooks and flexible holder rolled up, said carrier bag is affixed to said flexible holder in a manner to retain an upward end of said flexible holder to said first end of said stick when said flexible holder is unrolled and said carrier bag is positioned over the first end of said stick;

e. a tubular stand sized to receive the second end of said stick;

f. at least two fold-up legs pivotally affixed to said tubular stand;

g. means for temporary maintenance of said legs in an unfolded use position;

h. means for holding said stick temporarily affixed in said tubular stand.

2. The device of claim 1 wherein said means for maintaining said legs in an unfolded use position includes a wire collar affixed to said tubular stand with extended wire braces that can snap into and out of apertures in said legs.

3. The device of claim 1 wherein said means for holding said stick temporarily affixed in said tubular stand includes a handle clip arranged to slide into apertures in said tubular stand.

* * * * *